United States Patent [19]

Pedersen

[11] Patent Number: 4,516,942

[45] Date of Patent: May 14, 1985

[54] TOWER MOUNTED MOORING APPARATUS

[75] Inventor: Kristen I. Pedersen, Houston, Tex.

[73] Assignee: Sofec, Inc., Houston, Tex.

[21] Appl. No.: 478,837

[22] Filed: Mar. 25, 1983

[51] Int. Cl.[3] ..... B63B 21/52

[52] U.S. Cl. ..... 441/5

[58] Field of Search ..... 441/3-5; 114/230; 141/377, 388

[56] References Cited

U.S. PATENT DOCUMENTS

| | | | |
|---|---|---|---|
| 3,472,293 | 10/1969 | Bily | 114/230 |
| 3,479,673 | 11/1969 | Manning | 441/5 |
| 3,722,223 | 3/1973 | Gratz | 114/230 |
| 3,823,432 | 7/1974 | Van Heijst | 441/5 |
| 3,899,990 | 8/1975 | Lecomte | 114/230 |
| 3,908,212 | 9/1975 | Van Heijst | 441/5 |
| 4,010,500 | 3/1977 | Reid, Jr. | 441/5 |
| 4,309,955 | 1/1982 | Kentosh | 114/230 |
| 4,351,260 | 9/1982 | Tuson et al. | 114/230 |

FOREIGN PATENT DOCUMENTS

| | | | |
|---|---|---|---|
| 49549 | 4/1982 | European Pat. Off. | 441/5 |

*Primary Examiner*—Trygve M. Blix
*Assistant Examiner*—Jesûs D. Sotelo
*Attorney, Agent, or Firm*—Dodge & Bush

[57] ABSTRACT

A single point mooring apparatus for tanker loading and discharging is disclosed having a fixed mooring tower and a yoke connected to the fixed tower by a triaxial articulation element for allowing the yoke to move while connected to a vessel in yaw, pitch and roll with respect to the mooring base. The yoke is shaped to straddle the bow of the moored vessel and is suspended above the water line with weighted pendants on port and starboard sides of the vessel, providing a resilient position restoring force to the vessel. Fluid transfer swivels and flexible hose connections in the cargo transfer conduits are all located above the water line.

7 Claims, 4 Drawing Figures

TOWER MOUNTED MOORING APPARATUS

BACKGROUND OF THE INVENTION

1. Field of the Invention

This invention relates generally to the technology of mooring vessels such as oil tankers, floating barges, and the like, to a station where fluids may be flowed from a producing well or storage area to the vessel. In particular, the invention relates to a single point mooring system for vessels on a body of water.

2. Description of the Prior Art

The exploitation or operation and certain offshore oilfields as well as other industrial applications often requires the mooring of ships or floating vessels which are used for the storage of products and/or the transporting of fluids after extraction from a well.

Single point mooring systems have frequently been used in offshore locations for the loading and unloading of hydrocarbons or other flowable cargos into or out of marine vessels such as tankers, barges and the like. Many such systems have been developed and are now in use for both loading and unloading hydrocarbons at offshore locations. Examples of such conventional systems include the catenary anchor leg mooring (CALM) apparatus and the single anchor leg mooring (SALM) apparatus.

The catenary anchor leg mooring system (CALM) holds a floating buoy by an array or pattern of anchors attached by mooring chains or lines. The vessel which is to be loaded is attached to the floating buoy by suitable mooring ropes or a rigid mooring arm. In such a mooring system the position restoring mooring forces are provided by the horizontal force component in the mooring chains. However, in shallow water it has been difficult to arrange the mooring chains with sufficient slack to provide adequate resiliency or horizontal spring in the mooring system. In such instances, the horizontal movement of a moored vessel caused by external forces due to waves, winds and currents can cause sudden extremely large forces which may exceed the capacity of the mooring system to maintain the vessel in the hydrocarbon transferring mode.

Conventional single anchor leg mooring systems (SALM) have used one floating mooring buoy attached with a suitable chain or articulated arm to a lower base structure fixed to the sea bottom or floor. By submerging the buoy to a certain depth, a desired tension level is created in the anchor leg. The tension provides a constant restoring or horizontal urging force for resiliently mooring a floating vessel to the buoy. In shallow water the vessel position restoring capacity of the SALM mooring system is also reduced and not suitable for mooring large vessels. Completely submerged mooring systems have been proposed, but such systems are complicated by providing moving mechanical parts below the surface of the water.

In view of the disadvantages of the prior art systems for mooring vessels in shallow waters, there has developed a need for a mooring system having moving parts completely above the high high water level of the body of water yet provided resiliency and restoring forces to a moored vessel while keeping it on station.

U.S. Pat. No. 4,351,260, issued in the name of Tuson et al., discloses single point mooring systems in which a weighted member is submerged or floating in the water and is attached at the mid-point of articulated legs and provides a resilient restoring force to the moored vessel.

However, the system disclosed in the above identified patent has a disadvantage in that articulated legs between a tower and the vessel itself may be subject to mechanical instabilities and the like.

An object of this invention is to provide a single point mooring and fluid product transfer system for a tanker vessel floating on a body of water having its rotating and moving elements and specifically all product carrying swivels and hose connections continuously above the high high water level of the body of water and having an inherent resilient restoring force in response to wind, wave and currents acting on the vessel.

It is a further object of this invention to provide a mooring system having a unitary yoke attached to a triaxial articulation mounted above the surface of the body of water on a rigid tower extending from the ocean floor, the mooring system being adapted to move in response to surge, sway, heave, yaw, pitch and roll motions of the moored vessel.

It is a further object of the invention to provide weighting mounting means on a connecting yoke to secure weighting blocks providing a restoring force to the vessel.

It is another object of the invention to provide yoke suspension means with wear free articulations between the yoke and to the vessel.

SUMMARY OF THE INVENTION

These and other objects and features of the invention are incorporated in the disclosed mooring system having a tower means on which is mounted a triaxial articulation means for connection of one end of a yoke, the other end of the yoke being connected to the vessel by way of a yoke suspension means. The yoke is a unitary structure having a "V" shape with the closed end of the "V" being connected to the triaxial articulation means. The two open arms of the V straddle the bow of the vessel and are connected to the vessel by rigid shafts, chains or wire rope tendons via universal joints attached both on the vessel and to the arms. Weight holding means on the outward ends of the two arms provide means to secure heavy weights to the yoke, resulting in large axial tension in the yoke suspension means. As the yoke suspension means are inclined as a result of wind, wave and current forces acting on the vessel, the horizontal component of the axial forces in the yoke suspension means provides a self-actuating but resilient position restoring force to the moored vessel.

Flexible conveying hoses extend from the vessel via the yoke to the tower means for conveying the flowable cargo to be loaded on the vessel or to be off-loaded from the vessel.

The triaxial articulation means mounted at the top of the tower comprises a turntable means mounted on the tower deck for rotation about a substantially vertical axis. A coupling means mounted on the turntable means is rotatable about a first pin means with its rotation axis disposed substantially horizontal and parallel to the rotation plane of the turntable. Second pin means, oriented substantially orthogonally to the first pin means, is rigidly mounted with respect to the coupling means and is rotatably connected to the yoke means with its rotation axis aligned substantially along the longitudinal axis of the yoke means.

BRIEF DESCRIPTION OF THE DRAWINGS

The invention will be better understood and further objects, characterizing features, advantages and details thereof will appear more clearly as the following detailed description proceeds with reference to the accompanying drawings, of which.

DESCRIPTION OF THE INVENTION

Figure 1:
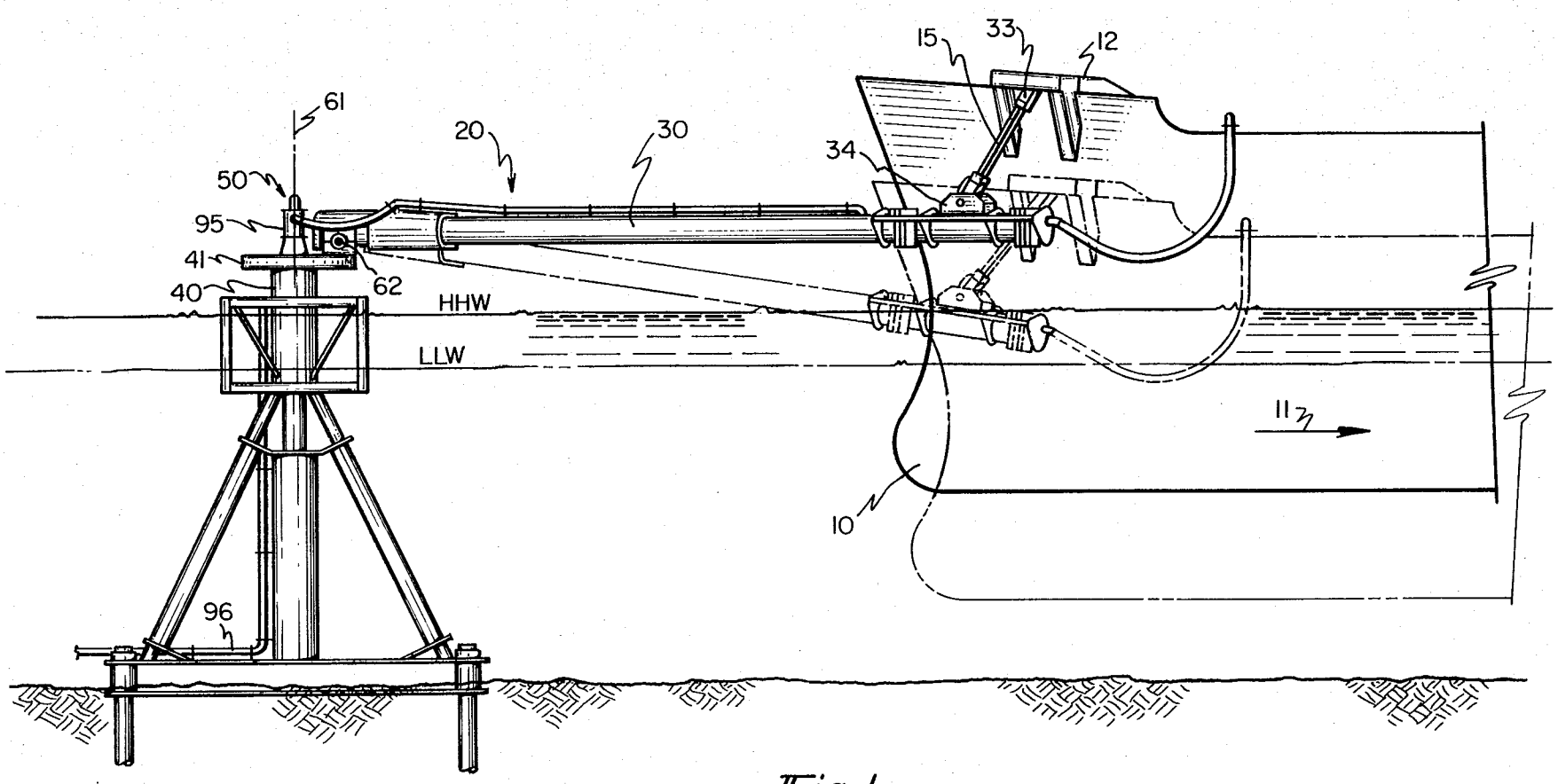
FIG. 1 is an elevation drawing showing the mooring system including a tower and triaxial articulation means disposed to the top of the tower and a vessel at two positions illustrating a heavily loaded vessel at low low water conditions and an empty vessel at high high water conditions.

FIG. 1 illustrates the single point mooring apparatus of the invention in which a vessel 10 is shown moored to a mooring system shown generally at 20. The vessel is shown in two positions. The first shows the vessel conditions of high high water (HHW) of the body of water and moderate forces acting on the vessel tending to force the vessel away from the mooring. The second, at a low low water condition (LLW) is also illustrated under conditions tending to force the vessel away from the mooring. Under conditions of an empty vessel at HHW, the yoke suspension means 15 is selected such that the yoke 30 securing the vessel 10 to the tower 40 is substantially horizontal and parallel to the surface of the water.

A triaxial articulation means 50 allows the yoke 30 to move in yaw, pitch and roll in response to such motions on the ship 10 with respect to tower 40. Yoke suspension means 15 connects the outer ends of arms 31 and 32 of yoke 30 to mooring brackets 12 on the vessel. Structural members 51, 52 and 53 provide strength and stability to yoke 30. The yoke suspension means 15 may advantageously be multiple wire rope tendons or heavy chains or alternatively may be a rigid metallic shaft with means for axial swiveling of one end relative to the other. The yoke suspension means 15 in combination with universal joints 33 and 34 connected to the vessel sides and to the outer end of each yoke arm advantageously allow a strain and wear free three degree of freedom rotation between the yoke suspension means 15 and the vessel 10 or the outer ends of yoke 30. Under conditions of a fully loaded vessel at LLW, the yoke 30 is inclined downwardly with respect to the surface of the water.

Figure 2:
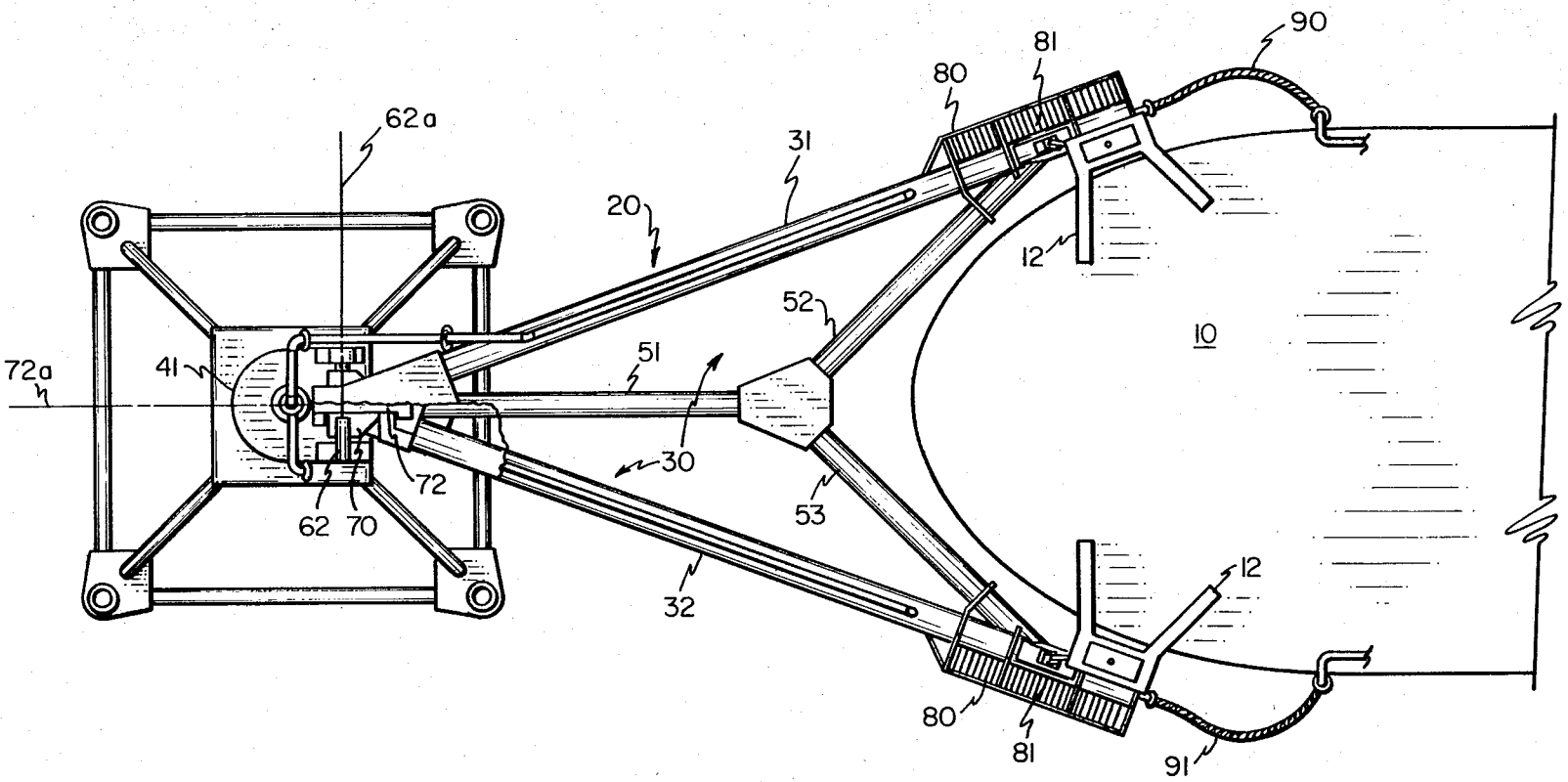
FIG. 2 is a plan view of the mooring system showing the "V" shaped nature of the yoke and a preferred piping system.

FIG. 2 shows a plan view of the mooring system. The triaxial articulation means shown generally at 50 comprises a turntable structure 41 mounted on the tower shaft 40 and a coupling means 70 connecting the turntable 41 to the yoke 30. The turntable 41 is adapted for rotation about a substantially vertical axis 61. A first pin 62 is mounted in the coupling 70 coaxial with the pitch axis **62*a* and rotatably connects the coupling means 70 to the turntable structure 41. A second pin 72 is also mounted in the coupling 70 and is oriented orthogonally to the first pin 62. The apex end of yoke 30 is free to rotate about pin 72. Thus the yoke 30 is free to yaw, pitch and roll about the three mutually orthogonal axes 61, 62*a* and 72*a*** while securely attached to the fixed column shaft.

The outer ends of yoke 30 contain weight holding means 80 for securing heavy weights 81, which may be high density concrete blocks and the like sufficient to provide an adequate position restoring force to the vessel via yoke suspension means 15 as the suspension pendants are inclined as a result of wind, wave and current forces 11, acting on the moored vessel. The weighted yoke suspension means 15, universal joints 33 and 34 and yoke 30 in combination with triaxial articulation means 50 thus provide a resilient position restoring force to the vessel and simultaneously allows the moored vessel to surge, heave, sway, pitch, yaw and roll in response to wind, wave and current forces.

Flexible conveying hoses 90 and 91 are provided for connection from either side of the vessel to piping along the yoke and to a product swivel 95 mounted on the turntable 41 providing a conduit to a submarine pipeline 96. Alternatively rigid piping with fluid transfer swivel articulations may be provided.

Figure 3:
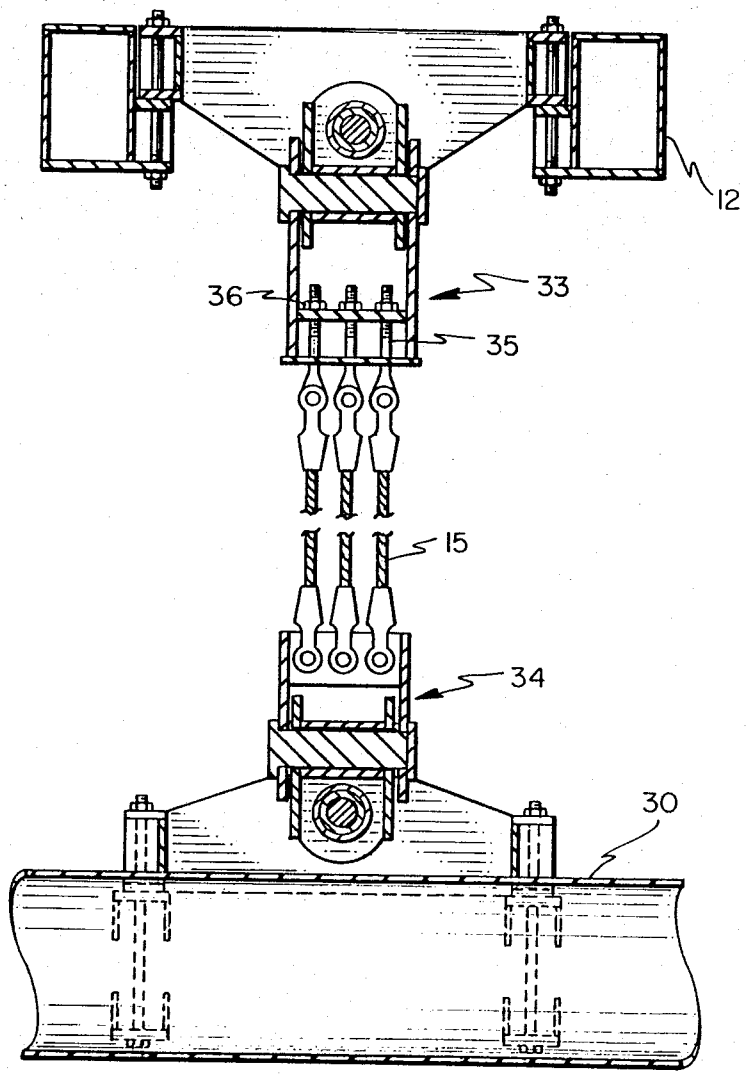
FIG. 3 is a detailed view of one embodiment of the yoke suspension means connecting the open end of the yoke with the mooring vessel.

FIG. 3 shows a detailed view of yoke suspension means 15 and universal joints 33 and 34 in the embodiment where the suspension means are multiple wire rope tendons. Only three tendons are shown while in actuality there may be several rows of tendons with two or more tendons in each row. This embodiment of suspension means 15 will absorb twisting of the suspension tendons (due to yawing motions of the yoke and the vessel) without need for special axial swiveling means.

An important feature of this embodiment of suspension means 15 is the arrangement provided for equalizing the loads on the individual tendons. The wire rope tendons are attached at one end, preferably at the upper universal joint 33, to threaded rods 35 with adjustment nuts 36. This arrangement permits adjustment of the tension in each individual tendon and also easy replacement of single tendons while the yoke weight remains suspended on the remaining tendons.

Figure 4:
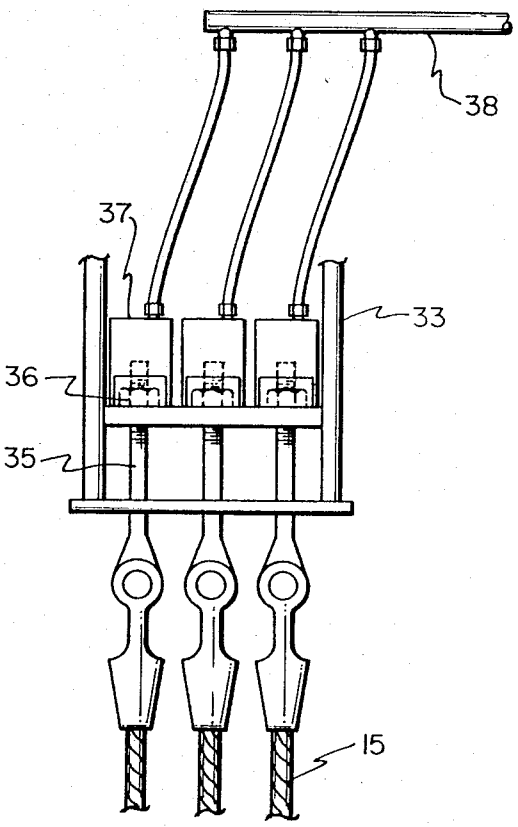
FIG. 4 is a detail of a hydraulic tensioning arrangement for equalizing the load on the multiple wire rope suspension tendons illustrated in FIG. 3.

FIG. 4 shows the preferred means of equalizing the tension in the tendons. Each of the individual tendons in a group of multiple tendons will be tensioned simultaneously by standard hydraulic bolt tensioners 37. The hydraulic tensioner grips the outer end of the threaded rods 35 and pulls the tendons 15 to the required tension. The stop nuts 36 are then seated tight while the hydraulic tension is still effective, after which the hydraulic pressure is released and the hydraulic tensioners 37 is removed.

All hydraulic tensioners 37 will be in one group of tendons and be pressurized from a common hydraulic pressure line 38, thus insuring equal tension in all tendons in the group regardless of differences in initial length or different stretch ratios for individual tendons.

Thus there has been provided a single point mooring system according to the invention in which the yoke and yoke suspension means are disposed above the water surface at either high high water and emtpy loading of the vessel or low low water and full loading of the vessel. Such a mooring system having its moving parts disposed above the surface of the water provides a means for mooring a vessel to an offshore pipeline or the like while substantially protecting the moving parts of the system and specifically the product carrying swivels and flexible hoses from submersion in the sea while providing a resilient restoring mooring force to the vessel in response to forces tending to force the vessel away from the mooring and provides a means for connecting the vessel to a fixed tower while allowing for surge, sway, heave, pitch and roll motions of the vessel.

Various modifications and alterations in the described structures will be apparent to those skilled in the art of the foregoing description which does not depart from the spirit of the invention. For this reason, these changes are desired to be included in the appended claims. The appended claims recite the only limitations to the present invention and the descriptive manner which is employed for setting forth the embodiments and is to be interpreted as illustrative and not limitative.

What is claimed is:

1. Mooring apparatus for mooring and loading or discharging a tanker vessel in a body of water comprising, a stationary tower fixed to the floor of the body of water, said tower fixed in a vertical position having a tower shaft extending above the surface of the water, unitary yoke means having two arms forming a "V" shape, the closed end of the V shaped yoke means attached to the tower shaft by a triaxial articulation means disposed on said shaft above the surface of the water for allowing the yoke means to move in yaw, pitch and roll with respect to the tower, yoke suspsension means for connecting the outer ends of the two arms of the yoke means to the vessel for maintaining the yoke means substantially above water under conditions of a fully loaded vessel at low low water, and for allowing the yoke means to move in yaw, pitch and roll with respect to the vessel, and weighting means removably disposed in the outer ends of the two arms of the yoke means to provide in combination with the yoke suspension means, a self-acting restoring force to the vessel with respect to the tower means.

2. The mooring apparatus of claim 1 wherein the triaxial articulation means comprises a turntable means mounted on said tower shaft for rotation about a vertical axis, a coupling means mounted on said turntable means and rotatable about a first pin means disposed substantially horizontal and parallel to the turntable plane of rotation, and a second pin means oriented substantially orthogonally to said first pin means and mounted rigidly with respect to said coupling means and rotatably connected to said yoke means with its rotation axis aligned substantially along the longitudinal axis of the yoke means.

3. The mooring apparatus of claim 1 further comprising piping and flexible loading hose means connected between the storage vessel and the tower means and transfer swivel means for providing a fluid flow-conveying connection between the stationary tower and the vessel.

4. Mooring apparatus for mooring and loading or discharging a tanker vessel in a body of water comprising, tower means fixed to the floor of the body of water and having a tower shaft extending above the surface of the water, unitary yoke means attached at its first end to the tower shaft by a triaxial articulation means for allowing the yoke means to move in yaw, pitch and roll with respect to the tower, yoke suspension means for connecting the second end of the yoke means to the vessel and for maintaining the yoke means substantially above water under conditions of a fully loaded vessel at low low water, and weighting means removably disposed in the second end of the yoke to provide in combination with the yoke suspension means, a self-acting restoring force to the vessel with respect to the tower means, wherein the yoke means comprises a "V" shaped member having its closed end connected to the triaxial articulation means and having weight holding means disposed outwardly along the two arms of the V, wherein the yoke suspension means comprises first and second suspension elements connected between the outward ends of the two arms and support brackets on port and starboard sides of the vessel, and wherein the first and second suspension elements are connected between universal joints mounted on the sides of the vessel and on the outward ends of the two arms of the yoke.

5. The mooring apparatus of claim 4 wherein the first and second suspension elements are multiple wire rope tendons with means for equalizing the tension in all tendons on each of the first and second suspension elements.

6. The mooring apparatus of claim 4 wherein the first and second suspension elements each comprise at least one chain including chain swivel means for axial rotation of each chain leg.

7. The mooring structure of claim 4 wherein the first and second suspension elements are rigid shafts with means for axial swiveling of one end relative to the other.

* * * * *